US011125097B2

(12) United States Patent
Feldmann

(10) Patent No.: US 11,125,097 B2
(45) Date of Patent: Sep. 21, 2021

(54) SEGMENTED RING FOR INSTALLATION IN A TURBOMACHINE

(71) Applicant: MTU Aero Engines AG, Munich (DE)

(72) Inventor: Manfred Feldmann, Eichenau (DE)

(73) Assignee: MTU Aero Engines AG, Munich (DE)

( * ) Notice: Subject to any disclaimer, the term of this patent is extended or adjusted under 35 U.S.C. 154(b) by 189 days.

(21) Appl. No.: 16/453,093

(22) Filed: Jun. 26, 2019

(65) Prior Publication Data

US 2020/0003067 A1 Jan. 2, 2020

(30) Foreign Application Priority Data

Jun. 28, 2018 (DE) ..... 102018210601.0

(51) Int. Cl.
*F01D 11/08* (2006.01)

(52) U.S. Cl.
CPC ..... *F01D 11/08* (2013.01); *F05D 2240/11* (2013.01); *F05D 2240/55* (2013.01)

(58) Field of Classification Search
CPC ..... F01D 11/08; F01D 9/04; F01D 11/005; F01D 11/12; F01D 11/001; F05D 2240/11; F05D 2240/55
See application file for complete search history.

(56) References Cited

U.S. PATENT DOCUMENTS

RE21,272 E * 11/1939 Hallerberg ..... F02M 35/026 96/233
2,651,496 A * 9/1953 Buckland ..... F01D 9/065 415/135
2,835,515 A * 5/1958 Solari ..... F16J 15/38 277/397
2,936,155 A * 5/1960 Raymond ..... F01D 5/26 416/134 R
3,303,992 A * 2/1967 Johnson ..... F01D 17/162 415/149.4

(Continued)

FOREIGN PATENT DOCUMENTS

DE 2232151 A 4/1973
EP 1431515 A2 6/2004

(Continued)

*Primary Examiner* — Woody A Lee, Jr.
*Assistant Examiner* — Brian Christopher Delrue
(74) *Attorney, Agent, or Firm* — Davidson, Davidson & Kappel, LLC

(57) ABSTRACT

A segmented ring for installation in a turbomachine, circumferentially divided into segments, considered with respect to a ring axis of the segmented ring, wherein the segmented ring is adapted for installation from radially inside; i.e., the segments can be assembled radially outwardly to form the segmented ring. At least two immediately circumferentially adjacent segments meet in a joint at which a sealing insert is provided. A pocket which is open toward the joint is formed in each of the at least two immediately circumferentially adjacent segments; i.e., two circumferentially mutually facing pockets are provided at the joint. The sealing insert is disposed in the two mutually facing pockets and axially retained therein and extends circumferentially across the joint, and a pocket of the two mutually facing pockets is additionally also open in a radial direction such that this segment can be radially slid onto the sealing insert.

17 Claims, 4 Drawing Sheets

(56) References Cited

U.S. PATENT DOCUMENTS 3,487,879 A * 1/1970 McCarthy ..... F04D 29/324 416/220 R
3,728,041 A * 4/1973 Bertelson ..... F01D 25/246 415/189
3,843,279 A * 10/1974 Crossley ..... F01D 9/042 415/191
3,870,434 A * 3/1975 Paulson ..... F01D 7/00 416/160
3,887,297 A * 6/1975 Welchek ..... F04D 29/563 415/161
3,929,392 A * 12/1975 Ogino ..... F16C 33/1075 384/215
3,970,318 A * 7/1976 Tuley ..... F01D 11/005 277/641
4,047,840 A * 9/1977 Ravenhall ..... F02K 3/06 416/135
4,363,600 A * 12/1982 Thebert ..... F01D 17/162 415/140
4,395,195 A * 7/1983 De Cosmo ..... F01D 11/001 415/137
4,498,790 A * 2/1985 Fisher ..... F01D 17/162 384/296
4,514,141 A * 4/1985 Marey ..... F01D 17/162 415/160
4,604,030 A * 8/1986 Naudet ..... F01D 11/001 415/126
4,706,354 A * 11/1987 Naudet ..... F01D 17/162 29/428
4,834,613 A * 5/1989 Hansen ..... F01D 17/162 415/160
4,861,228 A * 8/1989 Todman ..... F01D 17/162 415/115
4,877,376 A * 10/1989 Sikorski ..... B64C 11/04 416/207
4,897,021 A * 1/1990 Chaplin ..... F01D 5/22 415/173.7
4,990,056 A * 2/1991 McClain ..... F01D 11/001 29/889.22
5,022,824 A * 6/1991 Violette ..... B64C 11/008 416/230
5,102,302 A * 4/1992 Schilling ..... B64C 11/04 416/224
5,165,856 A * 11/1992 Schilling ..... B64C 11/04 416/204 R
5,205,714 A * 4/1993 Shah ..... F01D 5/26 416/220 R
D341,145 S * 11/1993 Esworthy ..... D15/143
5,259,728 A * 11/1993 Szpunar ..... F01D 5/3007 416/2
5,281,089 A * 1/1994 Brown ..... F01D 5/225 415/173.1
5,324,165 A * 6/1994 Charbonnel ..... F01D 11/003 415/160
5,387,082 A * 2/1995 Matyscak ..... F01D 11/005 415/139
5,517,817 A * 5/1996 Hines ..... F01D 17/162 415/115
5,636,968 A * 6/1997 Audet ..... F01D 17/162 415/160
5,653,580 A * 8/1997 Faulder ..... F01D 9/042 415/137
5,664,536 A * 9/1997 Bigsby ..... F16J 9/24 123/193.4
5,796,199 A * 8/1998 Charbonnel ..... F01D 17/162 310/60 A
6,086,327 A * 7/2000 Mack ..... F01D 17/162 384/273
6,129,512 A * 10/2000 Agram ..... F01D 17/162 415/160
6,257,593 B1 * 7/2001 White ..... F16J 15/064 277/630
6,318,728 B1 * 11/2001 Addis ..... F01D 11/001 277/355
6,435,519 B1 * 8/2002 White ..... F16J 15/0806 277/609
6,457,721 B1 * 10/2002 Bloemers ..... F16J 9/24 277/445
6,481,960 B2 * 11/2002 Bowen ..... F01D 11/001 415/160
6,550,779 B2 * 4/2003 Bjornson ..... F16J 15/3488 277/370
6,637,995 B1 * 10/2003 White ..... F16B 19/02 411/339
6,682,299 B2 * 1/2004 Bowen ..... F01D 11/001 415/160
6,790,000 B2 * 9/2004 Wolf ..... F01D 17/162 415/165
D517,900 S * 3/2006 Goldenberg ..... D8/354
7,244,098 B2 * 7/2007 Bromann ..... F01D 17/162 415/160
7,360,990 B2 * 4/2008 Barbe ..... F01D 17/162 384/296
7,510,369 B2 * 3/2009 Lytle ..... F04D 29/563 415/160
7,670,106 B2 * 3/2010 Bouru ..... F01D 17/162 415/160
8,328,512 B2 * 12/2012 Major ..... F01D 17/162 415/209.4
D681,512 S * 5/2013 Verbowski ..... D12/159
8,448,993 B2 * 5/2013 Cumic ..... F16L 21/065 285/112
8,770,930 B2 * 7/2014 Merrill ..... F01D 5/147 415/190
8,951,010 B2 * 2/2015 Major ..... F01D 17/162 415/209.4
9,353,643 B2 * 5/2016 Major ..... F01D 17/162
9,822,657 B2 * 11/2017 Gieg ..... F01D 11/08
9,874,243 B2 * 1/2018 McKinnon ..... B60B 27/00
9,926,944 B2 * 3/2018 Mouton ..... F04D 27/002
9,932,988 B2 * 4/2018 Maliniak ..... F01D 17/162
9,970,314 B2 * 5/2018 Stiehler ..... F04D 29/563
10,125,789 B2 * 11/2018 Maliniak ..... F04D 29/563
10,280,941 B2 * 5/2019 Mouton ..... F04D 29/644
10,287,904 B2 * 5/2019 Filipenco ..... F01D 25/246
10,344,612 B2 * 7/2019 Hudson ..... F04D 29/083
10,344,622 B2 * 7/2019 Amadon ..... F01D 25/243
2003/0113204 A1 * 6/2003 Wolf ..... F01D 25/16 415/165
2003/0170115 A1 * 9/2003 Bowen ..... F01D 9/02 415/160
2003/0202876 A1 * 10/2003 Jasklowski ..... F01D 11/025 415/135
2004/0071548 A1 * 4/2004 Wilson, Jr. ..... F01D 11/18 415/173.1
2006/0064988 A1 * 3/2006 Ingistov ..... F01D 11/001 60/805
2006/0216143 A1 * 9/2006 Trinks ..... F01D 25/246 415/173.1
2007/0059161 A1 * 3/2007 Bouru ..... F04D 29/563 415/160
2007/0166151 A1 * 7/2007 Burdgick ..... F01D 9/044 415/191
2008/0031730 A1 * 2/2008 Houradou ..... F01D 17/162 415/173.2
2008/0044284 A1 * 2/2008 Alvanos ..... F01D 11/02 416/193 A
2011/0044804 A1 * 2/2011 DiPaola ..... F01D 9/04 415/173.1
2011/0142651 A1 * 6/2011 Lhoest ..... F01D 11/125 416/182
2012/0051918 A1 * 3/2012 Glasspoole ..... F01D 5/026 416/204 A
2012/0243977 A1 * 9/2012 Simonet ..... F01D 25/246 415/173.3
2012/0319360 A1 * 12/2012 Blaney ..... F01D 11/08 277/590

(56) References Cited

U.S. PATENT DOCUMENTS

2014/0234086 A1* 8/2014 Maliniak ..... F04D 29/563 415/159
2014/0271105 A1* 9/2014 Pietrobon ..... F01D 11/08 415/1
2015/0082807 A1* 3/2015 Rauch ..... F02C 3/045 60/796
2015/0098813 A1* 4/2015 Jarrett, Jr. ..... F01D 17/162 415/209.3
2015/0192028 A1* 7/2015 Gieg ..... F01D 11/08 415/173.1
2015/0330237 A1* 11/2015 Feldmann ..... F01D 25/246 415/137
2016/0084099 A1* 3/2016 Davis ..... F16J 15/0887 415/173.1
2016/0097287 A1* 4/2016 Goldfinch ..... F01D 5/323 416/220 R
2016/0146053 A1* 5/2016 McCaffrey ..... F01D 25/24 415/173.1
2016/0208637 A1* 7/2016 Maliniak ..... F01D 25/16
2016/0290360 A1* 10/2016 Tanaka ..... F04D 29/526
2016/0363133 A1* 12/2016 Mouton ..... F04D 29/563
2017/0044921 A1* 2/2017 Vetters ..... F01D 25/246
2017/0362958 A1* 12/2017 Von Berg ..... F01D 25/164
2018/0003067 A1* 1/2018 Bidkar ..... F01D 11/003
2018/0023408 A1* 1/2018 Rice ..... F01D 25/24 415/173.1
2018/0023420 A1* 1/2018 Amadon ..... F01D 25/243 415/209.2
2018/0045218 A1* 2/2018 Mouza ..... F01D 25/243
2018/0087394 A1* 3/2018 Sarawate ..... F16J 15/0806
2018/0202306 A1* 7/2018 Hudson ..... F01D 11/025
2018/0334926 A1* 11/2018 Schmidt ..... F01D 9/04
2018/0347386 A1* 12/2018 Sellhorn ..... F01D 11/001
2018/0371930 A1* 12/2018 Sippel ..... C23C 16/325
2019/0127045 A1* 5/2019 Devaux ..... F01D 5/025
2019/0203842 A1* 7/2019 Bidkar ..... F16J 15/4476
2019/0323370 A1* 10/2019 Trivedi ..... F16J 15/3488
2020/0003076 A1* 1/2020 Feldmann ..... F01D 9/04
2020/0063578 A1* 2/2020 Notarnicola ..... F01D 9/04
2020/0158022 A1* 5/2020 McCaffrey ..... F01D 25/246

FOREIGN PATENT DOCUMENTS

EP 1431518 A2 6/2004
EP 1760272 A2 * 3/2007 ..... F01D 17/162
EP 2857639 A1 4/2015
EP 3239472 A1 11/2017
GB 705150 A * 3/1954 ..... F01D 9/065
WO WO2012041651 4/2012
WO WO-2015155442 A1 * 10/2015 ..... F01D 11/02

* cited by examiner

SEGMENTED RING FOR INSTALLATION IN A TURBOMACHINE

TECHNICAL FIELD

The present invention relates to a segmented ring for installation in a turbomachine.

BACKGROUND INFORMATION

The turbomachine may be, for example, a jet engine, such as a turbofan engine. The turbomachine is functionally divided into a compressor, a combustor and a turbine. In the case of the jet engine, for example, intake air is compressed by the compressor and mixed and burned with jet fuel in the downstream combustor. The resulting hot gas, a mixture of combustion gas and air, flows through the downstream turbine and is expanded therein. The turbine is typically divided into several modules; i.e., it may include, for example, a high-pressure turbine module and a low-pressure turbine module. Each of the turbine modules typically includes a plurality of stages, each stage being composed of a stator vane ring and a rotor blade ring downstream thereof.

The segmented ring in question is intended for installation in a turbomachine, for example in a turbine module. It may be mounted, for example, to a casing part and then carry a jacket ring segment disposed radially inwardly on the casing part. Such a jacket ring segment radially outwardly bounds the gas duct at the axial position of a rotor blade ring and may be provided radially inwardly with a sealing system or an abradable coating. This is intended to illustrate the present subject matter or a preferred application thereof, but initially not to limit the generality thereof (the segmented ring may also perform another mounting function in the turbomachine).

SUMMARY OF THE INVENTION

It is an object of the present invention to provide a particularly advantageous segmented ring.

The present invention provides a segmented ring that is adapted for installation or assembly from inside radially outward and for this purpose is circumferentially divided into segments. To reduce leakage, a sealing insert is inserted at a joint where two immediately circumferentially adjacent segments meet. To this end, each of the two segments has formed therein a pocket which is open toward the joint and in which the sealing insert is seated. The sealing insert is axially retained in the pockets and bridges the joint, and thus blocks clearance flows and increases tightness.

Furthermore, one of the mutually facing pockets is not only open toward the joint, but also in a radial direction. This is advantageous with respect to radial assembly of the segmented ring, in particular complete and/or closed segmented ring, since the corresponding segmented ring can be slid radially onto the sealing insert without requiring a simultaneous displacement in a non-radial direction and/or an axial direction for this purpose and/or in particular for providing the complete and/or closed segmented ring. The segmentation and the assembly from radially inside open up interesting mounting possibilities on the one hand, and since a joint formed between two segments is thereby additionally sealed, it is on the other hand nevertheless possible to limit possible leakage. Due to the inventive design of the pockets, the joint can be closed by a sealing insert, which provides efficient sealing while still allowing assembly from radially inside.

Preferred embodiments will be apparent from the dependent claims and the entire disclosure. In the description of the features, a distinction is not always drawn specifically between device, method and use aspects. In any case, the disclosure should be read to imply all claim categories. In particular, it should always be read as relating to both the segmented ring and an assembly or module having such a segmented ring, as well as to corresponding uses.

In the context of the present disclosure, "axial" generally relates to the ring axis of the segmented ring. In the installed state; i.e., when installed in the turbomachine or a module thereof, the ring axis typically coincides with the longitudinal axis of the turbomachine or the axis or rotation about which the rotor blade rings rotate. "Radial" refers to the radial directions that are perpendicular to the ring axis or longitudinal axis and point away therefrom; and a "circumference," respectively "circumferential" or the "circumferential direction" relate to the rotation about the axis. "Forward" and "rearward" relate to the axial component of the direction of flow of the hot gas. Thus, the hot gas axially passes "forward" components before it passes "rearward" components. In the context of the present disclosure, "a" and "an" are to be read as indefinite articles and thus always also as "at least one," unless expressly stated otherwise. Reference is primarily made to "a" joint and the pocket, which is radially open there. Overall, there is a plurality or multiplicity of joints around the circumference; and preferably, a sealing insert is disposed at each of the joints. In principle, this could also be achieved with pockets which are only circumferentially open at the other joints (the segment having the radially open pocket is positioned last), but preferably every one of the sealing inserts of the segmented ring is disposed in a respective radially open pocket.

The segmented ring; i.e., its segments, may be produced, for example, by turning and milling from a forged ring. However, the segments may also be cast parts (in conjunction with subsequent machining of the functional surfaces). Finally, additive manufacturing may also be used; i.e., the segmented ring or the segments may be additively built up layer by layer from a previously amorphous or shape-neutral material. The pockets may be taken into account already during the initial shaping process, but may also be formed by a material-removal process, such as, for example, by electrical discharge machining (spark machining).

The radially open pocket allows the corresponding segment to be slid radially onto the sealing insert. To this end, the pocket is oriented in the insertion direction in which the segment(s) are assembled. The insertion direction may generally also have an axial component (for example, when viewed in an axial section, it may be tilted from the radial direction by more than 30°); preferably, it is perpendicular to the axial direction. The radially open pocket could in principle also be open radially inwardly (and closed radially outwardly). During assembly, this segment would then be positioned first, and the other segment would subsequently be positioned together with the sealing insert which, in this process, would be disposed in the closed pocket thereof and would slide into the radially inwardly open pocket.

However, in a preferred embodiment, the radially open pocket is radially outwardly open and radially inwardly closed. Accordingly, the segment having this pocket can be slid from radially inside onto the sealing insert, which is already positioned in the pocket of the other segment. Unlike with a radially inwardly open pocket, in the installed state, the sealing insert is then secured from falling out radially inwardly and radially outwardly because the open pocket is oriented toward the casing wall.

In a preferred embodiment, the radially closed pocket is closed both radially inwardly and radially outwardly. Thus, preferably, the radially open pocket is open in exactly one radial direction, preferably radially outwardly, and the other pocket is closed in both radial directions. Thus, the sealing insert is already substantially captively retained in the closed pocket before the segments are assembled together. To provide protection against falling out, it is also generally possible to use a grease which holds the sealing insert like a glue.

With this also in mind, in a preferred embodiment, the closed pocket is dimensioned such that its depth taken perpendicular to the joint is at least 0.1 times its height taken parallel to the joint. The pocket is dimensioned so as to prevent the sealing insert from rotating out of position before the segments are assembled together. Further preferred lower limits of the depth are at least 0.2, 0.3 or 0.4 times the height, and possible upper limits (independent of the lower limits) may, for example, be at most 2, 1.5, 1 or 0.8 times the height.

In a preferred embodiment, the sealing insert is a sealing plate.

The sealing insert, in particular the sealing plate, which is, for example, a planar sealing plate, preferably seals the joint and/or an inter-segment gap the between immediately circumferentially adjacent segments in the axial direction. In the case of a planar sealing plate, the axial direction is preferably normal to the plane of the plate or at least substantially normal to this plane; i.e., has a maximum deviation of 10°, in particular 5°, from the exactly normal orientation.

In a preferred embodiment, a retaining ring is provided on which the segments of the segmented ring are seated and supported radially inwardly. To this end, the retaining ring may extend uninterruptedly in the circumferential direction. Preferably, the retaining ring is axially pressed into a receptacle in the segmented ring and retained by a press fit therein. At the receptacle, the segmented ring preferably forms a radially projecting projection behind which the retaining ring is axially form-fittingly retained. The projection is so dimensioned that the retaining ring can be axially pressed into place, but is then secured in the axially opposite direction. Preferably, this is assisted by a beveled face (saw-tooth profile) along which the retaining ring slides as it is pressed into place.

The embodiments described below relate to the orientation or extension of the abutting faces with which the segments of the segmented ring meet in a respective joint. Two immediately circumferentially adjacent segments have complementary abutting faces at the respective joint.

In a preferred embodiment, one of each two adjacent segments has abutting faces which are parallel to each other and thus parallel to an insertion direction of this segment (when viewed in the axial direction). Such a segment can be inserted radially outwardly, even when the two immediately circumferentially adjacent segments are already in position. Considered with respect to the segmented ring as a whole, the mutually parallel abutting faces are preferably oriented in such a way they or their projections toward the opposite side of the segmented ring frame its ring axis centrally therebetween.

In a preferred embodiment, such a segment having mutually parallel abutting faces has a pocket with a sealing insert therein at each of the two circumferential sides. Preferably, these two pockets are each radially outwardly open and radially inwardly closed. Preferably, every other segment in the circumferential direction has two mutually parallel abutting faces. Preferably, these segments are identical in construction among themselves, and the complementary segments interposed therebetween are also identical in construction among themselves, so that the entire segmented ring can be built using only two different types of segments.

In another preferred embodiment, the segment(s) is or are mounted in such a way that the segmented ring can ideally be built from only one type of segment. To this end, one of the segments that meet at the joint has an abutting face that is oblique to the radial direction there. Specifically, the oblique abutting face forms an angle $\alpha$ of at least 85° and no more than 110° with a connecting line extending diagonally through the segment to the outer corner of the oblique abutting face. Further preferred upper limits are no more than 100° or 95°; further preferred lower limits (independent of the upper limits) are at least 88° or 90° (with increasing preference in the respective order of mention). By suitably limiting the angle $\alpha$, the segment can be inserted even when the immediately circumferentially adjacent segments are already in their installed positions. To this end, the segment can initially be placed in position with its opposite abutting face and then, as it were, rotated into engagement with the oblique abutting face (see FIG. 4 for illustration).

In a preferred embodiment, the segment is provided with the radially outwardly open (and radially inwardly closed) pocket at this oblique abutting face. As described in the preceding paragraph, such a segment may initially be hooked into place with its opposite abutting face and then rotated into its installed position, during which movement the sealing insert slides into the radially outwardly open pocket of the segment. Preferably, all segments are identical in construction, and thus rotationally symmetric about the ring or longitudinal axis. The handling of only one type of segment may simplify assembly and warehousing.

The present invention also relates to a segmented ring assembly including a segmented ring as disclosed herein and a mounting part, preferably a casing part. The segmented ring is axially form-fittingly mounted on the mounting part, and specifically on a form-fitting element thereof. To this end, the individual segments are each radially outwardly assembled with the form-fitting element. Preferably, a jacket ring segment is mounted radially inwardly on the casing part (see also the remarks made at the outset). In this connection, the segmented ring serves for the mounting of the jacket ring segment; the segmented ring is mounted on the casing part, and the jacket ring segment then rests and is supported radially inwardly thereon. This configuration may be advantageous with respect to the thermal gradients (in particular in the casing area) and, in addition, allows for installation and removal from an axially forward end.

The present invention also relates to a turbine module having a such a segmented ring assembly, where a rotor blade ring is disposed radially inwardly of the jacket ring segment. Preferably, the segmented ring assembly is provided at the axially forward end of the turbine module. During an overhaul, the modules can on the one hand be relatively easily separated from one another; and then they are each also accessible from an axially forward end; on the other hand, the components that are disposed at the axially forward end may be highly stressed and therefore require frequent overhauling.

The present invention also relates to the use of a turbine module or a segmented ring or a corresponding segmented ring assembly in a turbomachine, in particular in a jet engine, such as, for example, a turbofan engine.

BRIEF DESCRIPTION OF THE DRAWINGS

The present invention will now be explained in more detail with reference to an exemplary embodiment. The individual features may also be essential to the invention in other combinations within the scope of the other independent claims, and, as above, no distinction is specifically made between different claim categories.

In the drawings.

DETAILED DESCRIPTION

Figure 1:
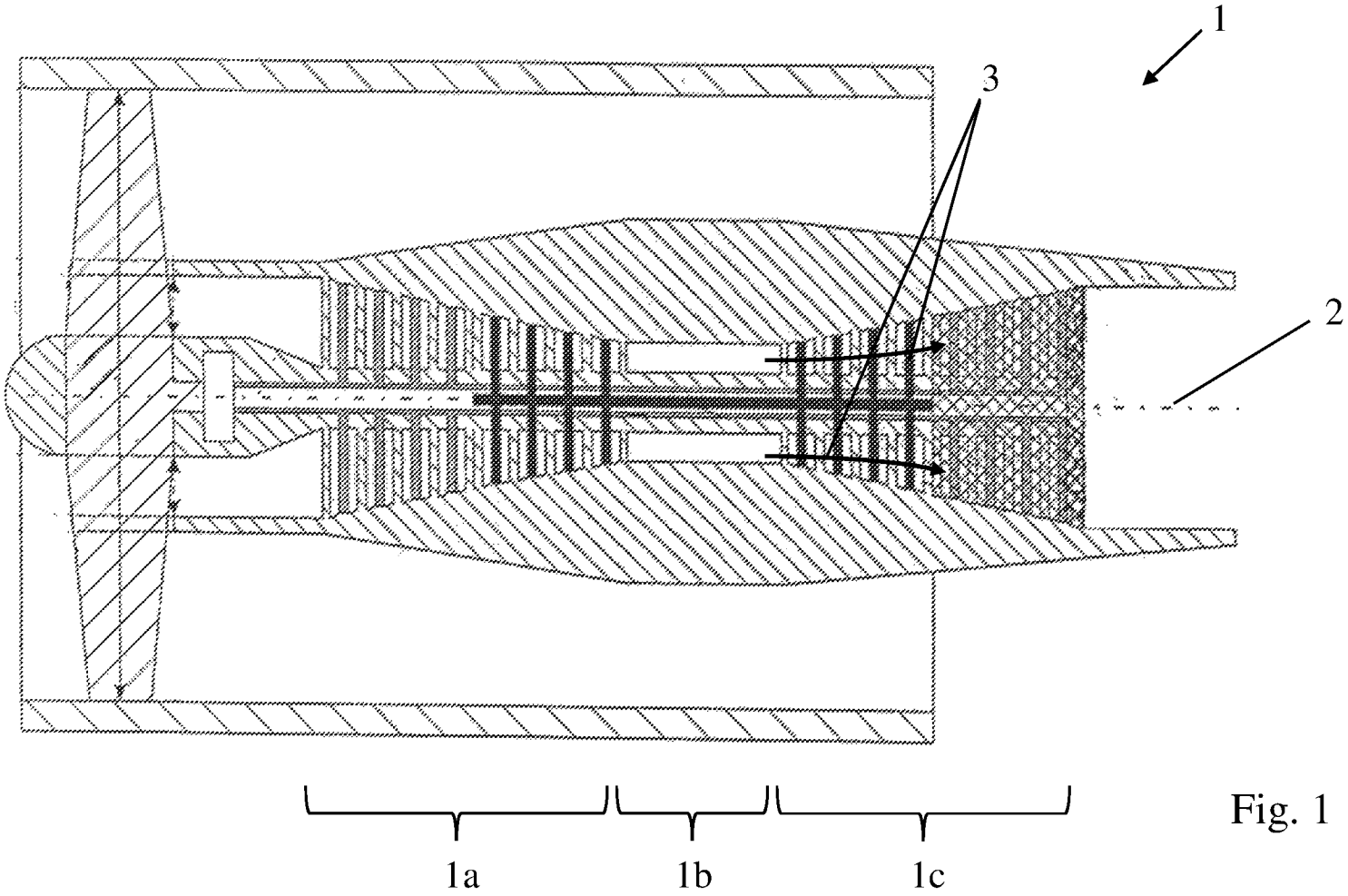
FIG. 1 shows an axial cross-sectional view of a turbofan engine.

FIG. 1 shows in axial section a turbomachine 1, specifically a turbofan engine. Turbomachine 1 is functionally divided into a compressor 1*a*, a combustor 1*b* and a turbine 1*c*. Both compressor 1*a* and turbine 1*c* are made up of a plurality of stages, each stage being composed of a stator vane ring and a subsequent rotor blade ring. During operation, the rotor blade rings rotate about longitudinal axis 2 of turbomachine 1. The intake air is compressed in compressor 1*a*, and is then mixed and burned with jet fuel in the downstream combustor 1*b*. The hot gas flows through hot gas duct 3, thereby driving the rotor blade rings that rotate about longitudinal axis 2.

Figure 2:
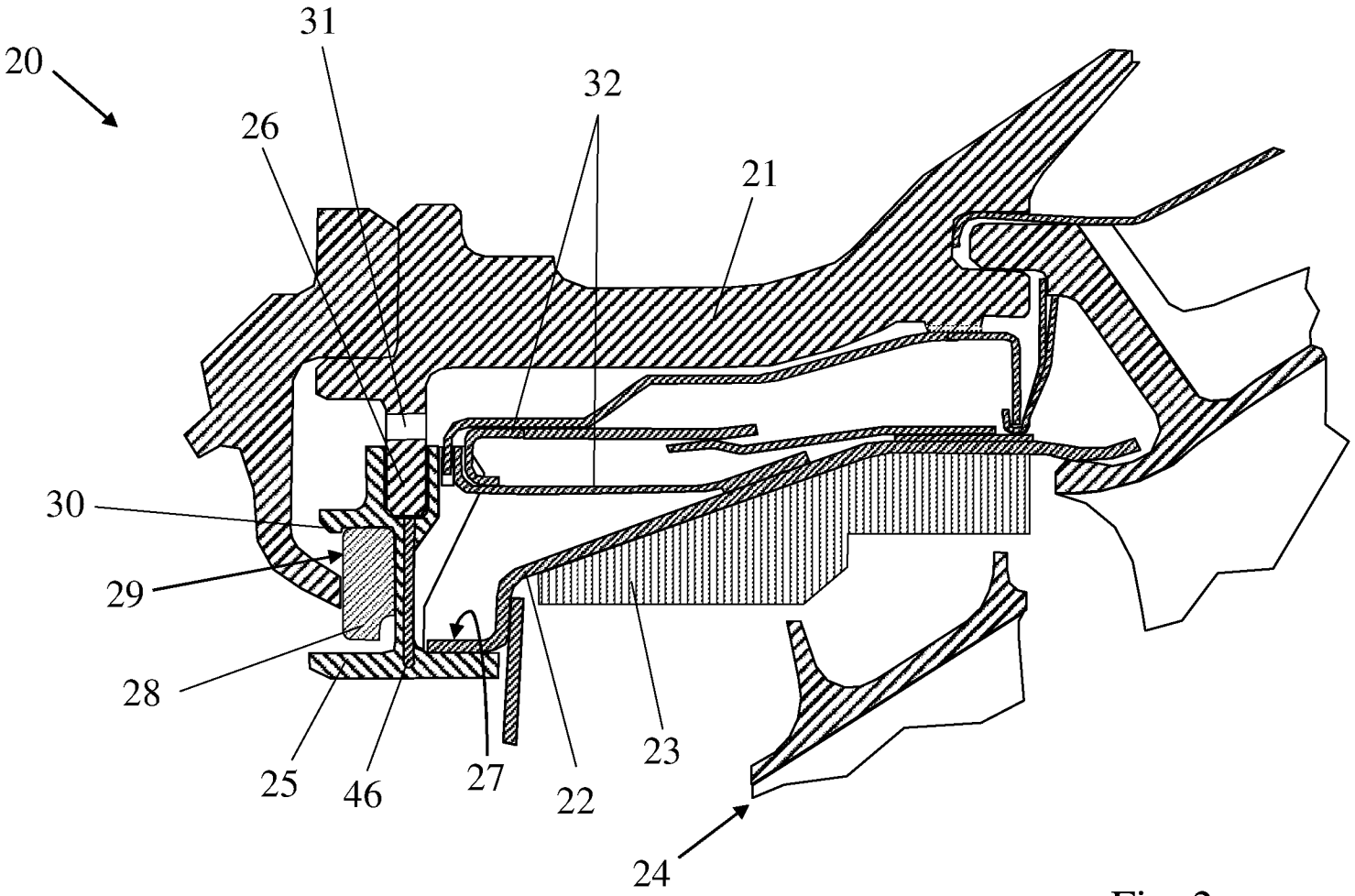
FIG. 2 shows an axial cross-sectional view of an inventive jacket ring assembly as part of the turbofan engine of FIG. 1.

FIG. 2 shows a jacket ring assembly 20 provided as part of a module of turbine 1*c*. It has a casing part 21 and a jacket ring segment 22 having a seal 23, here a honeycomb seal, disposed on the radially inner side thereof. Jacket ring segment 22 radially outwardly surrounds rotor blades 24.

Figure 3:
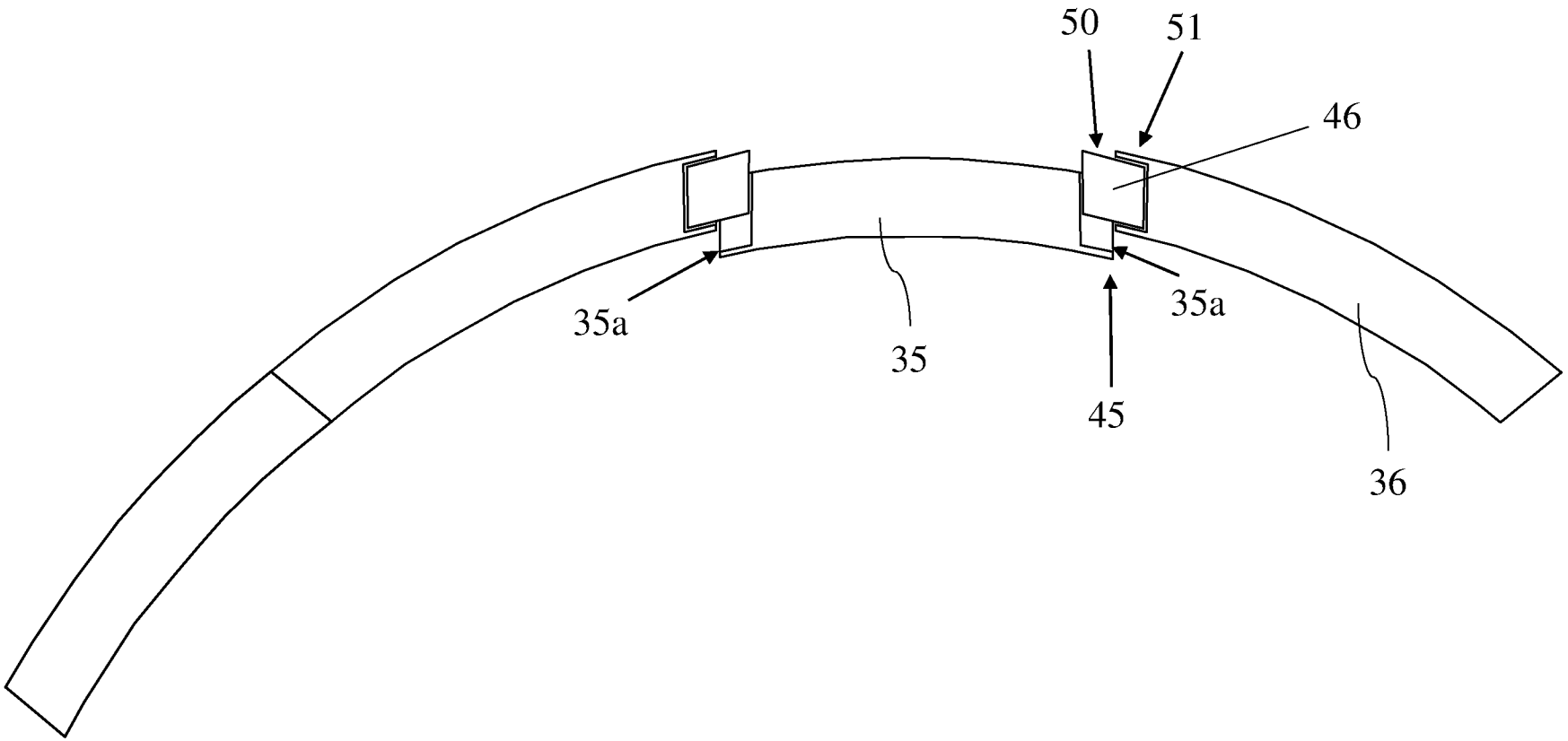
FIG. 3 shows a portion of a segmented ring of the assembly of FIG. 2 in a cross-sectional view taken perpendicular to the axial direction.
Figure 4:
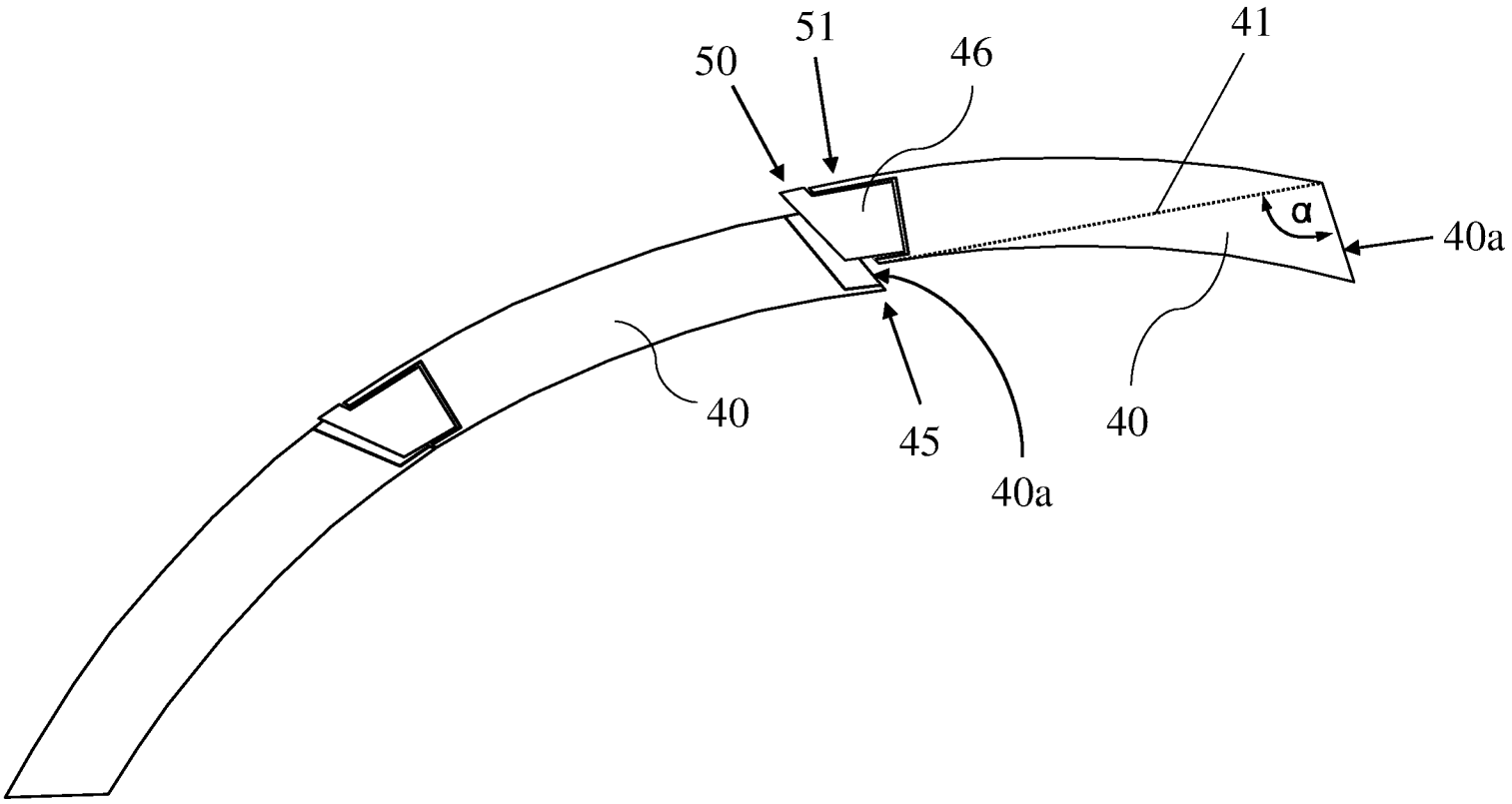
FIG. 4 shows, as an alternative to FIG. 3, a further option for the orientation of the abutting faces of the individual segments.

In order to mount jacket ring segment 22 on casing part 21, a segmented ring 25 is provided which is circumferentially divided into a plurality of segments (see FIGS. 3 and 4). The individual segments of segmented ring 25 are assembled from radially inside with a form-fitting element 26 of casing part 21. In the present case, form-fitting element 26 is provided as a radially inwardly projecting web of the casing, onto which the segments of segmented ring 25 are slid and are then axially form-fittingly retained. Segmented ring 25 forms a supporting seat 27 which radially inwardly supports jacket ring segment 22 at its axially forward end. A retaining ring 28 is inserted to retain the segments of segmented ring 25 radially in position. The retaining ring extends uninterruptedly in the circumferential direction and is axially pressed into a receptacle 29 of segmented ring 25. In receptacle 29, the retaining ring is axially form-fittingly retained behind a projection 30.

Form-fitting element 26; i.e., the web of casing part 21, is provided with a bore 31, which is optional and may be used to supply a cooling fluid. Furthermore, the shielding plates 32 disposed radially between casing part 21 and jacket ring segment 22 are also optional; the inventive approach could also be implemented with an insulating material or the like between casing part 21 and jacket ring segment 22.

FIG. 3 shows segmented ring 25 in a cross-sectional view taken perpendicular to longitudinal axis 2 (for the sake of clarity without hatching), and more specifically, a portion of segmented ring 25 including segments 35, 36. The two immediately circumferentially adjacent segments 35, 36 meet in a joint 45; a sealing insert 46, namely a sealing plate, is provided to seal joint 45. Each of the segments 35, 36 has a pocket 50, 51 formed therein at joint 45 to receive the sealing insert. (Sealing insert 46 can also be seen in the cross-sectional view of FIG. 2).

Pocket 51 in segment 36 is closed both radially inwardly and radially outwardly; sealing insert 46 is inserted in the circumferential direction. In contrast, pocket 50 in segment 35 is closed only radially inwardly, but open radially outwardly. During assembly, initially the segment 36 with the sealing insert 46 is positioned. Then, segment 35 with its mutually parallel abutting faces 35*a* can be inserted from radially inside, during which movement sealing insert 46 slides into the radially outwardly open pocket 50. The segment 35 is symmetrical in configuration, and thus has another radially outwardly open pocket at the other circumferential end.

FIG. 4 shows segments 40 having an alternative configuration to that shown in FIG. 3. In this case, the entire segmented ring 25 can be built from only one type of segment. To this end, an abutting face 40*a* of segment 40 is oriented obliquely to a connecting line 41 such that angle $\alpha$ is about 90°. In this case, too, at each joint 45 where two segments 40 meet, a sealing insert 46 is disposed in one segment 40 in a radially outwardly open pocket 50 and the in other segment 40 in a radially closed pocket 51. Sealing insert 46 is positioned in the latter, and the other segment 40 is subsequently rotated into its installed position, as illustrated in FIG. 4.

LIST OF REFERENCE NUMERALS

| | |
|---|---|
| turbomachine | 1 |
| compressor | 1a |
| combustor | 1b |
| turbine | 1c |
| longitudinal axis | 2 |
| hot gas duct | 3 |
| jacket ring assembly | 20 |
| casing part | 21 |
| jacket ring segment | 22 |
| seal | 23 |
| rotor blades | 24 |
| segmented ring | 25 |
| form-fitting element | 26 |
| supporting seat | 27 |
| retaining ring | 28 |
| receptacle | 29 |
| projection | 30 |
| bore | 31 |
| shielding plate | 32 |
| segment | 35 |
| abutting face | 35a |
| segment | 36 |
| abutting face | 36a |
| segment | 40 |
| abutting face | 40a |
| connecting line | 41 |
| joint | 45 |
| sealing insert | 46 |
| pockets | 50, 51 |

What is claimed is:

1. A segmented ring for installation in a turbomachine, the segmented ring comprising:

a first ring segments circumferentially dividing a plurality of second ring segments that form a complete ring when assembled with the first ring segment, considered with respect to a ring axis of the first ring segment, the segmented ring being adapted for installation from radially inside the second ring segments, so that the second ring segments are assemblable by moving radially outwardly to form the first ring segment; wherein the first segment and an adjacent second ring segment of the plurality of second ring segments directly adjacent to the first segment meet in a joint;

a sealing insert is provided at the joint, a first pocket being formed in the first segment at the joint and open toward the joint; and a second pocket being formed in the adjacent second ring segment provided at the joint and open toward the joint so that the first pocket faces the second pocket in the circumferential direction to form circumferentially mutually facing first and second pockets, the sealing insert being disposed in the mutually facing first and second pockets and axially retained in the mutually facing first and second pockets and extending circumferentially across the joint;

the first pocket being additionally also open in a radial direction such that the first ring segment having the first pocket is radially slidable onto the sealing insert.

2. The segmented ring as recited in claim 1 wherein the first pocket is radially inwardly closed and radially outwardly open; and thus the first segment having the first pocket is slidable from radially inside onto the sealing insert.

3. The segmented ring as recited in claim 1 wherein the second pocket is closed both radially inwardly and radially outwardly.

4. The segmented ring as recited in claim 3 second pocket has a depth, taken perpendicular to the joint, at least 0.1 times its height taken parallel to the joint.

5. The segmented ring as recited in claim 1 wherein the sealing insert is a sealing plate or wherein the sealing insert seals the joint in the axial direction.

6. The segmented ring as recited in claim 1 further comprising a retaining ring, the first ring segment and second ring segment being seated on the retaining ring and supported radially inwardly.

7. The segmented ring as recited in claim 1 wherein the first segment has an abutting face at the joint and an another abutting face at the circumferentially opposite end, and the abutting face and the other abutting face are parallel to each other when viewed in the axial direction.

8. The segmented ring as recited in claim 2 wherein the first segment has an abutting face at the joint and an another abutting face at the circumferentially opposite end, and the abutting face and the other abutting face are parallel to each other when viewed in the axial direction; and wherein the radially inwardly closed and radially outwardly open pocket is provided in the segment having the mutually parallel abutting faces, segment having the mutually parallel abutting faces also being provided, at the circumferentially opposite end, with an other radially inwardly closed and radially outwardly open pocket, another sealing insert being disposed in the other radially inwardly closed and radially outwardly open pocket.

9. The segmented ring as recited in claim 1 wherein the first segment has an oblique abutting face at the joint, when viewed in the axial direction, forming an angle $\alpha$ of at least 85° and no more than 110° with a connecting line extending between a point of intersection of the oblique abutting face with an outer periphery of the segmented ring and a point of intersection of an opposite abutting face of the segment with an inner periphery of the segmented ring.

10. The segmented ring as recited in claim 2 wherein the first segment has an oblique abutting face at the joint, when viewed in the axial direction, forming an angle $\alpha$ of at least 85° and no more than 110° with a connecting line extending between a point of intersection of the oblique abutting face with an outer periphery of the segmented ring and a point of intersection of an opposite abutting face of the segment with an inner periphery of the segmented ring; and wherein the pocket radially inwardly closed and radially outwardly open at the joint between the two adjacent segments is disposed at the oblique abutting face.

11. The segmented ring as recited in claim 1 wherein the plurality of the second ring segments are identical in construction.

12. A segmented ring assembly for a turbomachine comprising:

the segmented ring as recited in claim 1; and a mounting part having a form-fitting element having a radially inner projection, the segmented ring being axially form-fittingly disposed on the mounting part to allow the first and second the segments of the segmented ring to be fit to the form-fitting element by moving radially outwardly to be assembled with the radially inner projection of the form-fitting element.

13. The segmented ring assembly as recited in claim 2 further comprising a jacket ring segment adapted to radially outwardly surround a rotor blade ring of the turbomachine, wherein the mounting part on which the segmented ring is axially form-fittingly mounted is a casing part, and wherein the jacket ring segment is mounted radially inwardly of the casing part by the segmented ring forming a supporting seat and the jacket ring segment being seated and supported radially inwardly thereon with an axially forward end.

14. A turbine module comprising the segmented ring assembly as recited in claim 3 and a rotor blade ring, the rotor blade ring radially outwardly surrounded by a jacket ring segment.

15. The turbine module as recited in claim 14 wherein the segmented ring assembly is disposed at an axially forward end of the turbine module.

16. A turbomachine comprising the segmented ring as recited in claim 1.

17. A jet engine comprising the segmented ring as recited in claim 1.

* * * * *